US012371833B2

(12) United States Patent
Abbe et al.

(10) Patent No.: US 12,371,833 B2
(45) Date of Patent: Jul. 29, 2025

(54) FABRIC RETENTION CLIP AND RAIL

(71) Applicant: GRACEWOOD MANAGEMENT, INC., West Jordan, UT (US)

(72) Inventors: Eddie Abbe, West Valley City, UT (US); Cody Wayment, West Valley City, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/458,812

(22) Filed: Aug. 30, 2023

(65) Prior Publication Data

US 2024/0068142 A1 Feb. 29, 2024

Related U.S. Application Data

(60) Provisional application No. 63/374,051, filed on Aug. 31, 2022.

(51) Int. Cl.
*D05B 39/00* (2006.01)

(52) U.S. Cl.
CPC ..... *D05B 39/005* (2013.01)

(58) Field of Classification Search
CPC ..... D05B 39/005; D05B 11/00; D05B 33/00; D05B 39/00; D05C 1/02
See application file for complete search history.

(56) References Cited

U.S. PATENT DOCUMENTS

| | | | | |
|---|---|---|---|---|
| 479,654 | A * | 7/1892 | Moore et al. | D05B 11/00 112/119 |
| 4,658,522 | A | 4/1987 | Kramer | |
| 5,586,400 | A | 12/1996 | Moore, III | |
| 6,209,240 | B1 | 4/2001 | Engle | |
| 6,393,797 | B1 * | 5/2002 | Romes | B65H 16/00 52/746.1 |
| 6,615,756 | B2 | 9/2003 | Barrus | |
| 6,631,688 | B1 | 10/2003 | Maag | |
| 6,792,884 | B1 | 9/2004 | Barrus | |
| 6,932,008 | B2 | 8/2005 | Pfeifer | |
| 6,976,326 | B2 | 12/2005 | Tajima et al. | |
| 6,990,914 | B2 | 1/2006 | Canan | |
| 7,011,031 | B1 | 3/2006 | Bradley | |
| 7,377,222 | B1 | 5/2008 | Moore, III | |
| 8,281,726 | B2 | 10/2012 | Brunner et al. | |
| 9,145,630 | B2 | 9/2015 | McCoy et al. | |
| 9,476,151 | B2 | 10/2016 | Bagley | |
| 10,337,131 | B2 | 7/2019 | Konzak et al. | |
| 10,889,930 | B2 | 1/2021 | Bagley | |
| 10,920,352 | B2 | 2/2021 | Denning et al. | |
| 11,247,864 | B1 | 2/2022 | Martelli | |

(Continued)

FOREIGN PATENT DOCUMENTS

GB 221761 A * 9/1924 ..... B65H 75/16

*Primary Examiner* — Patrick J. Lynch
(74) *Attorney, Agent, or Firm* — Ryan L. Marshall; Jessica Kiser; Barnes & Thornburg LLP

(57) ABSTRACT

A quilting frame unit for supporting a quilt core to be sewn by a quilting machine includes a frame support structure and a frame assembly. The frame support structure is adapted to support a machine carriage assembly that provides for lateral and longitudinal movement of the quilting machine. The frame assembly is affixed to the frame support structure.

18 Claims, 11 Drawing Sheets

(56) References Cited

U.S. PATENT DOCUMENTS

| | | | | |
|---|---|---|---|---|
| 2005/0229446 | A1* | 10/2005 | Bagley | D05B 39/005<br>38/102.91 |
| 2008/0196221 | A1 | 8/2008 | Merlin Madrigal | |
| 2017/0051445 | A1 | 2/2017 | Bagley | |
| 2017/0107652 | A1 | 4/2017 | McKinney | |
| 2021/0131000 | A1 | 5/2021 | Bagley | |
| 2022/0008857 | A1* | 1/2022 | Lapelosa | B01D 46/185 |
| 2022/0025564 | A1 | 1/2022 | Bagley et al. | |

* cited by examiner

FABRIC RETENTION CLIP AND RAIL

CROSS-REFERENCE TO RELATED APPLICATIONS

This application claims the benefit of U.S. Provisional Application Nos. 63/374,051, filed Aug. 31, 2022; the entire contents of this application is hereby incorporated by reference herein.

FIELD OF THE DISCLOSURE

The present disclosure relates generally to device and methods for machine quilting and more specifically to quilting frame and other devices for positioning and retention of fabric for sewing with a quilting machine.

BACKGROUND

Devices for machine quilting typically consist of three primary components, a frame, a sewing machine, and a machine carriage having a carriage bottom plate that travels laterally on an x-axis and a carriage top plate that travels longitudinally on a y-axis. Quilt fabric layers, which typically consist of backing fabric, batting, and top fabric, but may consist of as few as one layer of fabric or more than three layers, which single fabric layer, or multiple layers collectively.

For a typical quilting frame, the fabric layers are rolled onto fabric layer rails and fed from the respective fabric layer rails to a take-up rail that passes through the throat of the sewing machine, suspending the fabric layers of the quilt core together to rest on the sewing machine bed. For a typical quilting frame, in order for the fabric layers of the quilt core to remain flat and straight, it is necessary for the fabric layer rails and the take-up rail to be longer than the quilt is wide.

For a typical quilting frame, the sewing machine is positioned on and secured to the quilting frame carriage top plate and is guided on the machine carriage to create a desired stitching pattern as the layers of fabric are quilted together. The sewing machine, and particularly the needle bar of the sewing machine, is guided longitudinally and laterally across the available quilting work area, which is determined by the length of the throat of the sewing machine and the width of the quilt fabric itself, the width of the quilt being limited to the width of the quilting frame. When the fabric in the work area has been sewn, the fabric is rolled forward from the fabric layer rails to the take-up rail so that the completed area is rolled onto the take-up rail which passes through the throat of the sewing machine. This also advances the fabric that has not yet been quilted into the work area, and the new strip of un-quilted fabric area may then be sewn. A typical quilting frame may need that the quilt be sewed from front to back, or vice versa, with the fabric progressively being fed onto the take-up rail as each strip of the quilt core is sewn from one side of the quilt core to the other.

An alternative to machine quilting with a traditional frame is to quilt by hand, performing all the stitching without a sewing machine, simply using a needle and thread. Another alternative is to baste the three layers of fabric together using pins or small stitches later to be removed. Once the fabric is basted, the user can quilt the layers together by guiding the fabric through the machine by hand. Hoops may also use to hold small areas of the quilt flat and straight to perform the stitching. Embroidery machines, for example, use a hoop to hold the fabric and then through motor control, move the hoop while the sewing machine stitches to create the desired patterns on the fabric.

Quilting without a frame may need basting and is time consuming. Hand quilting or quilting by using a hoop may also need basting, and moving the fabric to create the sewing patterns can be cumbersome due to the amount of fabric that has to be manipulated in a large quilt. Machine quilting on a frame is often a much more convenient and expeditious way to complete a quilt. The frame, however, may need to be large in order to make large quilts. Additionally, there may need to be a way to retain the quilt on the frame to save space, as many quilters do not have enough space to accommodate the large quilting frame.

SUMMARY

The present disclosure may comprise one or more of the following features and combinations thereof.

A quilting frame unit for supporting a quilt core to be sewn by a quilting machine may include a frame support structure adapted to support a machine carriage assembly, a frame assembly affixed to the frame support structure, and a retention system. The machine carriage assembly may provide for lateral and longitudinal movement of the quilting machine. The frame assembly may include a plurality of fabric support members configured to support the quilt core relative to the quilting machine.

In some embodiments, the retention system may include one or more quilt core retention members. Each quilt core retention member may include a retention clip, a front fabric retainer arm, and a rear fabric retainer arm. The retention clip may be configured to selectively couple to one support member of the plurality of fabric support members with the quilt core draped over the plurality of fabric support members to retain the quilt core to the one support member. The front fabric retainer arm that extends from the retention clip away from the one support member. The rear fabric retainer arm may extend from the retention clip away from the one support member.

In some embodiments, the rear fabric retainer arm may be spaced apart longitudinally from the front fabric retainer arm to define a quilt-core roll receiving channel. The quilt-core roll receiving channel may be configured to receive a quilt core roll of unsewn or previously sewn fabric of the quilt core to support the quilt core roll relative to the frame assembly when the quilt core is draped over the frame assembly.

In some embodiments, the retention system may further include a spring-biased retention clamp for each quilt core retention member. The spring-biased retention clamp may be pivotably coupled to the front fabric retainer arm of the respective quilt core retention member to change between a closed position and an open position. In the closed position, the retention clamp may extend between the front and rear fabric retainer arms to engage the quilt core roll located in the quilt-core roll receiving channel to block the quilt core roll from moving out of the quilt-core roll receiving channel. In the open position, the retention clamp may be spaced apart from the rear fabric retainer arm to allow the quilt core roll to move out of the quilt-core roll receiving channel.

In some embodiments, the spring-biased retention clamp may include a clamp arm, a rod, and a spring. The rod may pivotably couple the clamp arm to the front fabric retainer arm. The spring may extend between the clamp arm and the front fabric retainer arm. The spring may be configured to provide a clamping force to the clamp arm to urge the clamp arm toward the closed position.

In some embodiments, the retention clip may include a clip base, a first deflectable clip arm, and a second deflectable clip arm. The first deflectable clip arm may extend from a first end of the clip base. The second deflectable clip arm may extend from a second end of the clip base.

In some embodiments, the second end of the clip base may be spaced apart from the first end of the clip base to define a support-member receiving channel. The support-member receiving channel may be configured to receive the one support member with the quilt core draped over the one support member. In some embodiments, the front fabric retainer arm, the rear fabric retainer arm, and the clip base may cooperate to define the quilt-core roll receiving channel.

In some embodiments, each of the first and second deflectable clip arms may include an engagement portion and a lip portion. The engagement portion may define a plurality of frame receiver facets. Each of the frame receiver facets may be configured to engage with grooves on the one support member to couple the retention clip to the one support member. The lip portion may extend from the engagement portion away from the one support member to a terminal end. In some embodiments, the lip portion of the first deflectable clip arm and the lip portion of the second deflectable clip arm may define a clip throat therebetween.

In some embodiments, the front and rear fabric retainer arms may extend at an angle. The front and rear fabric retainer arms may extend at an angle relative to one another.

In some embodiments, the front and rear fabric retainer arms of the retention member may be each shaped to include a base and a lip. The base may extend from the retention clip. The lip may extend from the base to a terminal end.

In some embodiments, the lip of the front fabric retainer arm and the lip of the rear fabric retainer arm may define a retention member throat therebetween. The base of the front fabric retainer arm and the base of the rear fabric retainer arm may define a base width that is less than a width of the retention member throat.

In some embodiments, the retention clip may include clip base and a pair of deflectable clip arms. The pair of deflectable clip arms may extend from opposite ends of the clip base.

In some embodiments, the clip base and the pair of deflectable clip arms may cooperate to define a support-member receiving channel. The support-member receiving channel may be configured to receive the one support member with the quilt core draped over the one support member. In some embodiments, the front fabric retainer arm, the rear fabric retainer arm, and the clip base may cooperate to define the quilt-core roll receiving channel.

In some embodiments, each deflectable clip arm included in the pair of deflectable clip arms may include an engagement portion and a lip portion. The engagement portion may define a plurality of frame receiver facets each configured to engage with grooves on the one support member to couple the retention clip to the one support member. The lip portion may extend from the engagement portion away from the one support member to a terminal end. The lip portion of a first deflectable clip arm and the lip portion of a second deflectable clip arm may define a clip throat therebetween.

In some embodiments, the frame assembly may include a first end fabric support member coupled to a first end support of the frame support structure, a second end fabric support member coupled to a second end support of the frame support structure, a front fabric support member that extends laterally between and interconnects the first end fabric support member and the second end fabric support member, and a rear fabric support member. The second end fabric support member may be spaced apart laterally from the first end fabric support member. The front fabric support member may extend laterally between and interconnect the first end fabric support member and the second end fabric support member. The rear fabric support member may be spaced apart longitudinally from the front fabric support member. The rear fabric support member may extend laterally between the first end support and the second end support of the frame support structure through a throat of the quilting machine.

In some embodiment, the one or more quilt core retention members may be configured to selectively couple to the rear fabric support member. The one or more quilt core retention members may be configured to selectively couple to the rear fabric support member with the quilt core draped over the rear fabric support member.

In some embodiments, the retention system may further include one or more secondary retention clips. The secondary retention clips may be configured to couple to one of the first end fabric support member, the second end fabric support member, and the front fabric support member with the quilt core draped over to retain the quilt core to the first end fabric support member, the second end fabric support member, or the front fabric support member.

In some embodiments, the first end fabric support member, the second end fabric support member, the front fabric support member, and the rear fabric support member may each have a substantially octagonal cross-section with a plurality of grooves. The one or more secondary retention clips may be configured to engage one of the first end fabric support member, the second end fabric support member, and the front fabric support member in one of the plurality of grooves to couple the secondary retention clip to the first end fabric support member, the second end fabric support member, or the front fabric support member.

In some embodiments, the one or more secondary retention clips may include a clip base and a pair of deflectable clip arms. The pair of deflectable clip arms may extend from opposite ends of the clip base to define a support-member receiving channel. The support-member receiving channel may be configured to receive one of the first end support member, the second end support member, and the front fabric support member with the quilt core draped over the first end support member, the second end support member, or the front fabric support member.

In some embodiments, the pair of deflectable clip arms may each be configured to engage one of the first end fabric support member, the second end fabric support member, and the front fabric support member in one of the plurality of grooves. the pair of deflectable clip arms may each engage one of the fabric support members to couple the secondary retention clip to the first end fabric support member, the second end fabric support member, or the front fabric support member.

According to another aspect of the disclosure, a quilt core retention device may be adapted to retain a quilt core to be sewn by a quilting machine to a quilting frame. The retention device may include a retention clip and a pair of fabric retainer arms.

In some embodiments, the retention clip may be configured to selectively couple a laterally-extending support member of the quilting frame with the quilt core draped over the support member to retain the quilt core to the support member. The retention clip may be shaped to define a support-member receiving channel configured to receive the support member of the quilting frame.

In some embodiments, the pair of fabric retainer arms may each extend from the retention clip away from the support member of the quilting frame. The pair of fabric retainer arms may be spaced apart longitudinally from one another to define a quilt-core roll receiving channel. The quilt-core roll receiving channel may be configured to receive a quilt core roll of unsewn or previously sewn fabric of the quilt core to support the quilt core roll relative to the quilting frame when the quilt core is draped over the quilting frame.

In some embodiments, the retention clip and the pair of fabric retainer arms may be integrally formed. The retention clip and the pair of fabric retainer arms may be integrally formed as a single piece component.

In some embodiments, the quilt core retention device may further include a spring-biased retention clamp. The spring-biased retention clamp may be pivotably coupled to one retainer arm included in the pair of fabric retainer arms to change between a closed position and an open position. In the closed position, the retention clamp may extend between the pair of fabric retainer arms to engage the quilt core roll located in the quilt-core roll receiving channel to block the quilt core roll from moving out of the quilt-core roll receiving channel. In the open position, the retention clamp may be spaced apart from the other retainer arm to allow the quilt core roll to move out of the quilt-core roll receiving channel.

In some embodiments, the retention clip of the quilt core retention member may include a clip base, a first deflectable clip arm that extends from a first end of the clip base, and a second deflectable clip arm that extends from a second end. The second end of the clip base may be spaced apart from the first end of the clip base to define the support-member receiving channel. The pair of fabric retainer arms and the clip base cooperate to may define the quilt-core roll receiving channel.

In some embodiments, each of the first and second deflectable clip arms may include an engagement portion and a lip portion. The engagement portion may define a plurality of frame receiver facets each configured to engage with grooves on the support member to couple the retention clip to the support member. The lip portion may extend from the engagement portion away from the support member to a terminal end. The lip portion of the first deflectable clip arm and the lip portion of the second deflectable clip arm may define a clip throat therebetween.

In some embodiments, the pair of fabric retainer arms may extend at an angle. The pair of fabric retainer arms may extend at an angle relative to one another.

In some embodiments, the retention clip may include a clip base and a pair of deflectable clip arms. The pair of deflectable clip arms may each extend from the clip base. The clip base and the pair of deflectable clip arms may cooperate to define a support-member receiving channel configured to receive the support member with the quilt core draped over the support member. The pair of fabric retainer arms and the clip base may cooperate to define the quilt-core roll receiving channel.

According to another aspect of the present disclosure, a method for retaining a quilt core to a quilt frame unit for sewing by a quilting machine may include providing quilting frame unit. The quilting frame unit may include a frame support structure adapted to support a machine carriage assembly, a frame assembly affixed to the frame support structure, and a retention system. The frame assembly may include a plurality of fabric support members.

In some embodiments, the retention system may include one or more quilt core retention members that each have a retention clip and a pair of fabric retainer arms. The pair of fabric retainer arms may each extend from the retention clip away from the support member of the quilting frame. The pair of fabric retainer arms may be spaced apart longitudinally from one another to define a quilt-core roll receiving channel.

In some embodiments, the method may further include draping the quilt core over the plurality of fabric support members of the frame assembly. In some embodiments, the method may further include coupling the retention clip of the quilt core retention member to a rear fabric support member included in the plurality of fabric support members of the frame assembly with the quilt core draped over the rear fabric support member to retain the quilt core to the rear fabric support member. In some embodiments, the method may further include locating a quilt core roll of unsewn or previously sewn fabric of the quilt core in the quilt core roll receiving to support the quilt core roll relative to the frame assembly when the quilt core is draped over the frame assembly.

These and other features of the present disclosure will become more apparent from the following description of the illustrative embodiments.

DETAILED DESCRIPTION OF THE DRAWINGS

Figure 1:
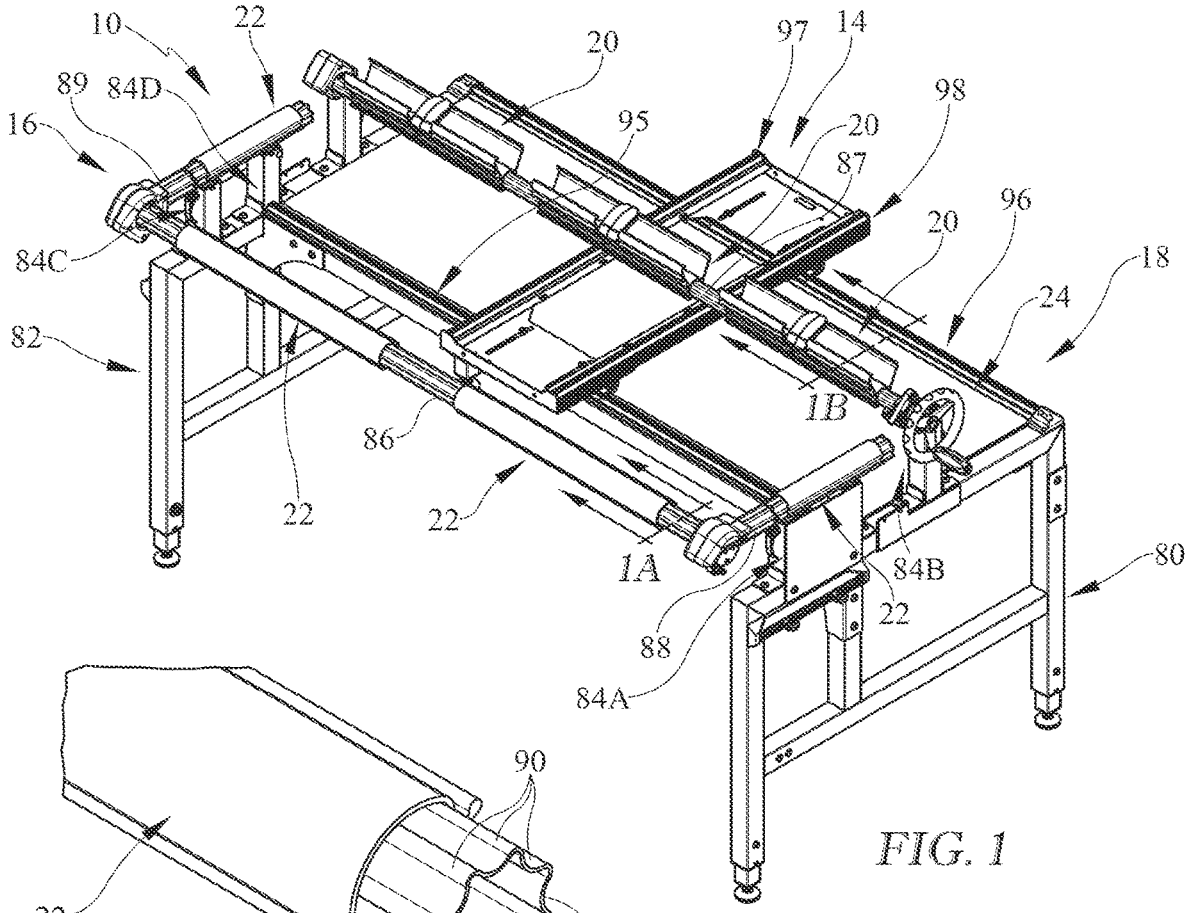
FIG. 1 is a front perspective view of a quilting frame unit showing the quilting frame unit includes a frame support structure adapted to support a machine carriage assembly above an underlying floor, a frame assembly affixed to the frame support structure to support a quilt core to be sewn by a quilting machine, and a retention system including quilt core retention devices configured be selectively coupled to a rear fabric support member of the frame assembly, secondary quilt core retention clips configured to be selectively coupled to a front fabric support member and side fabric support members of the frame assembly, and a tightening mechanism coupled to the rear fabric support member to control the tension of the quilt core supported on the frame assembly.
Figure 1A:
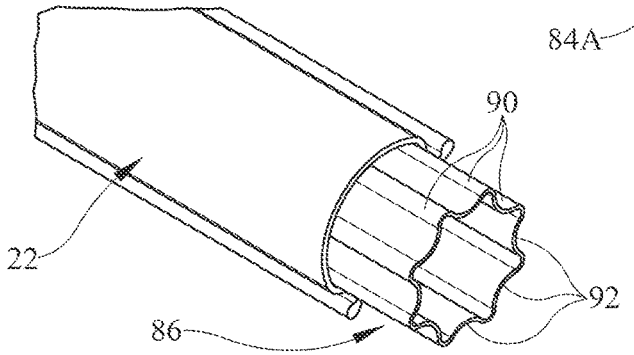
FIG. 1A is a cross-sectional detail view of the quilting frame unit of FIG. 1 taken along line 1A showing the front fabric support member has a substantially octagonal cross-sectional shape that forms ridges and grooves in the fabric support member and the secondary quilt core retention clips engage the front fabric support member in the grooves on the fabric support member to couple the retention clip to the support member.
Figure 1B:
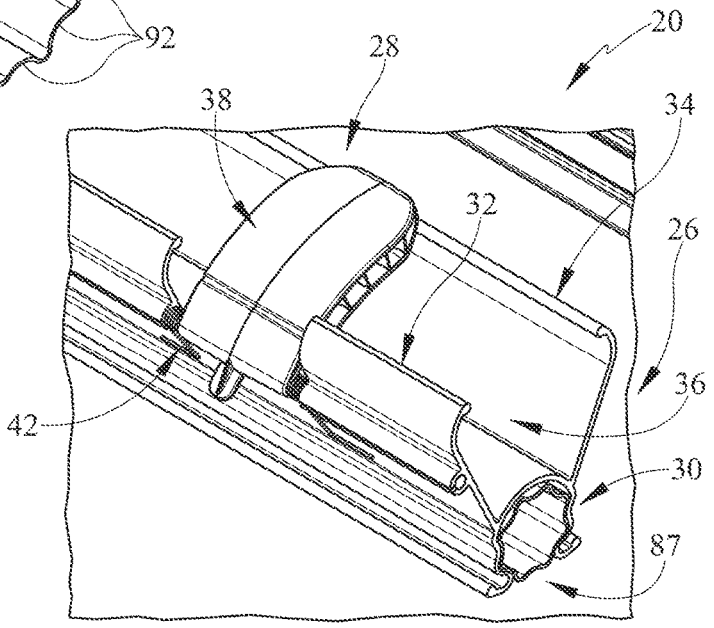
FIG. 1B is a cross-sectional detail view of the quilting frame unit of FIG. 1 taken along line 1B showing the quilt core retention device includes a retention member shaped to define a quilt-core roll receiving channel configured to receive a quilt core roll of the quilt core as shown in FIGS. 11 and 12 and a spring-biased retention clamp configured to be pivotably coupled to the retention member to change between a closed position as shown in FIG. 6 to an open position as shown in FIG. 7 to control access to the quilt core roll in the quilt-core roll receiving channel.

For the purposes of promoting an understanding of the principles of the disclosure, reference will now be made to a number of illustrative embodiments illustrated in the drawings and specific language will be used to describe the same.

Figure 2:
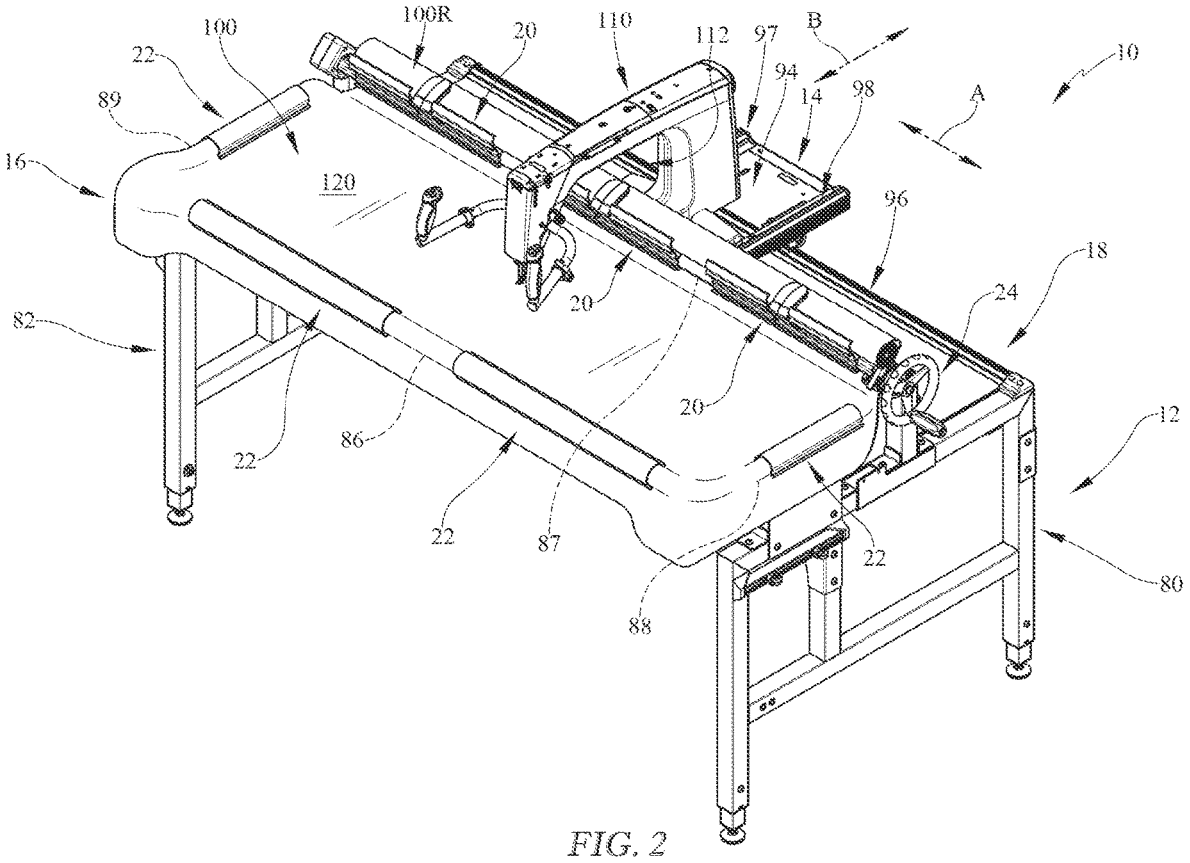
FIG. 2 is a front perspective view of the quilting frame unit of FIG. 1 showing the quilt core positioned on the frame assembly and secured to the frame assembly by the retention system so that a fabric zone of the quilt core is on the frame assembly for sewing by the quilting machine.

A quilting frame unit 10 for supporting a quilt core 100 to be sewn by a quilting machine 110 is shown in FIGS. 1 and 2. The quilting frame unit 10 includes a frame support structure 12, a machine carriage assembly 14, a frame assembly 16 including a plurality of fabric support members 86, 87, 88, 89 configured to support the quilt core 100 relative to the quilting machine 100, and a retention system 18. The frame support structure 12 is adapted to support the machine carriage assembly 14. The machine carriage assembly 14 provides for lateral and longitudinal movement of the quilting machine 110 as suggested by arrows A and B in FIG. 2. The frame assembly 16 is affixed to the frame support structure 12. The retention system 18 is configured to retain the quilt core 100 to the plurality of fabric support members 86, 87, 88, 89 of the frame assembly 16 so that the quilt core 100 is held in place on the frame assembly 16 while the quilt core 100 is being sewn.

To sew the quilt core, the quilt core is draped over the fabric support members 86, 87, 88, 89 of the frame assembly 16. The retention system 18 is then used to retain the quilt core 100 to the plurality of fabric support members 86, 87, 88, 89 of the frame assembly 16. This positions a fabric zone 120 of the quilt core 100 for sewing by the quilting machine 110. Successive fabric zones 130 of the quilt core 100 may be consecutively secured to the frame assembly 16 of the quilting frame unit 10 with the sewn fabric zones of the quilt core 100 advanced into the machine throat 112 of the quilting machine 110 and rolled onto a flexible take-up spool 114. This helps keep the fabric layers of the sewn fabric zones from interfering with the sewing of the successive fabric zone 130 positioned on the frame assembly 16 for sewing.

The retention system 18 includes one or more quilt core retention devices 20, one or more secondary retention clips 22, and a tightening mechanism 24 as shown in FIGS. 1 and 2. The quilt core retention devices 20 and the secondary retention clips 22 are configured to selectively couple with one of the fabric support members 86, 87, 88, 89 with the quilt core draped over to retain the quilt core 100 to the frame assembly 16. The tightening mechanism 24 is coupled to a rear fabric support member 87 of the frame assembly 16 that extends through the machine throat 112 of the quilting machine 110. The tightening mechanism 24 is configured to provide tension to the fabric zones 120, 130 so that the quilt core 100 is taunt for sewing by the quilting machine 110.

Figure 4:
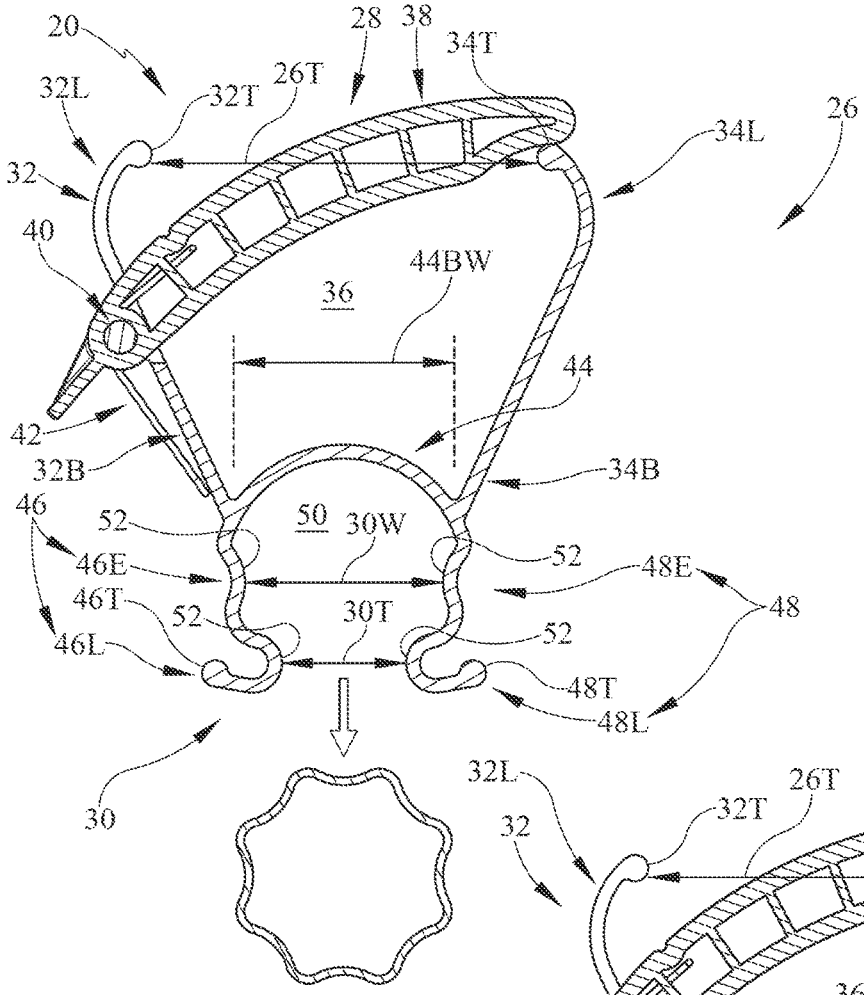
FIG. 4 is a cross-sectional view of one of the quilt core retention devices included in the retention system of the quilt frame unit of FIG. 1 showing the retention clip of the retention member includes a clip base and a pair of deflectable clip arms that each extend from the clip base to define a support-member receiving channel configured to receive the rear fabric support member of the frame assembly when the retention clip is coupled to the rear fabric support member of the frame assembly.
Figure 5:
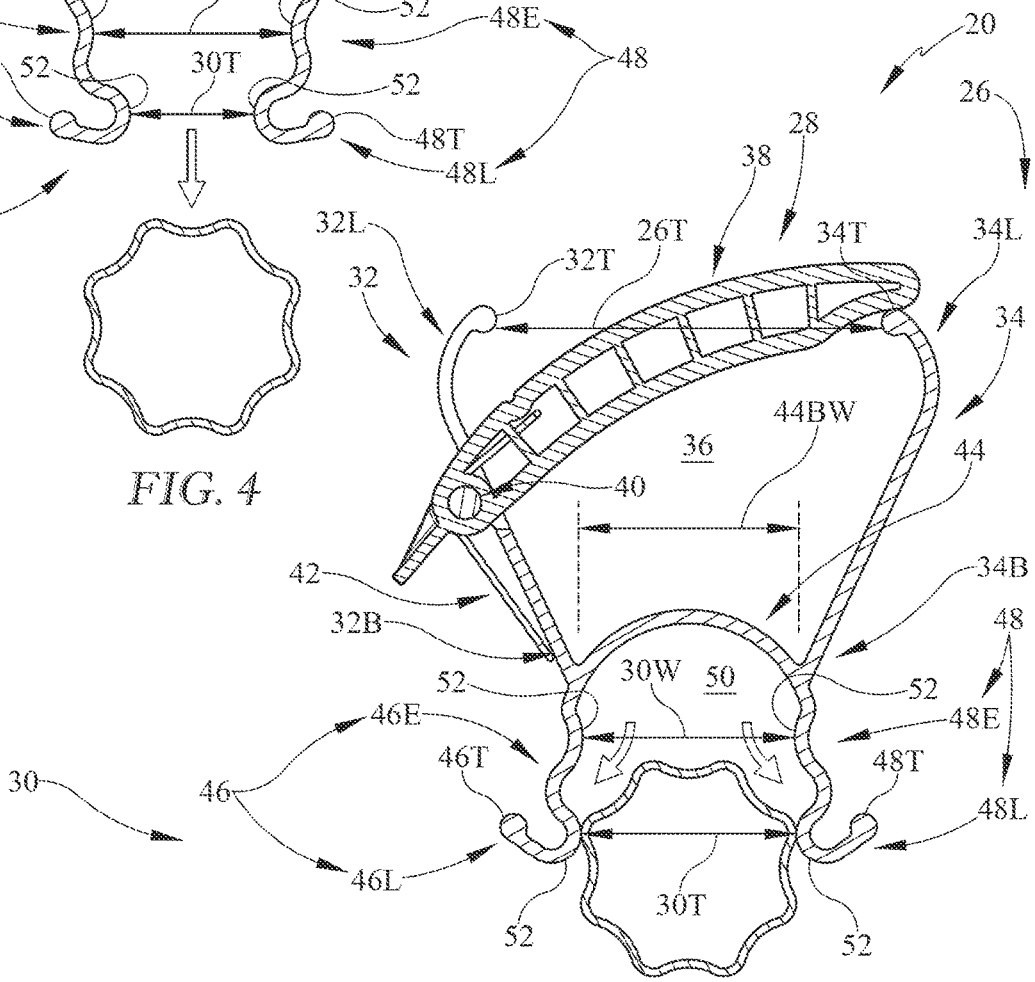
FIG. 5 is a cross-sectional view similar to FIG. 4 showing the retention clip of the retention member has been moved from an unengaged position as shown in FIG. 4 to a partially engaged position to cause the pair of deflectable clip arms to deflect relative the clip base to allow the rear fabric support member to move into the support-member receiving channel of the retention clip to couple the quilt core retention device to the rear fabric support member of the frame assembly.
Figure 6:
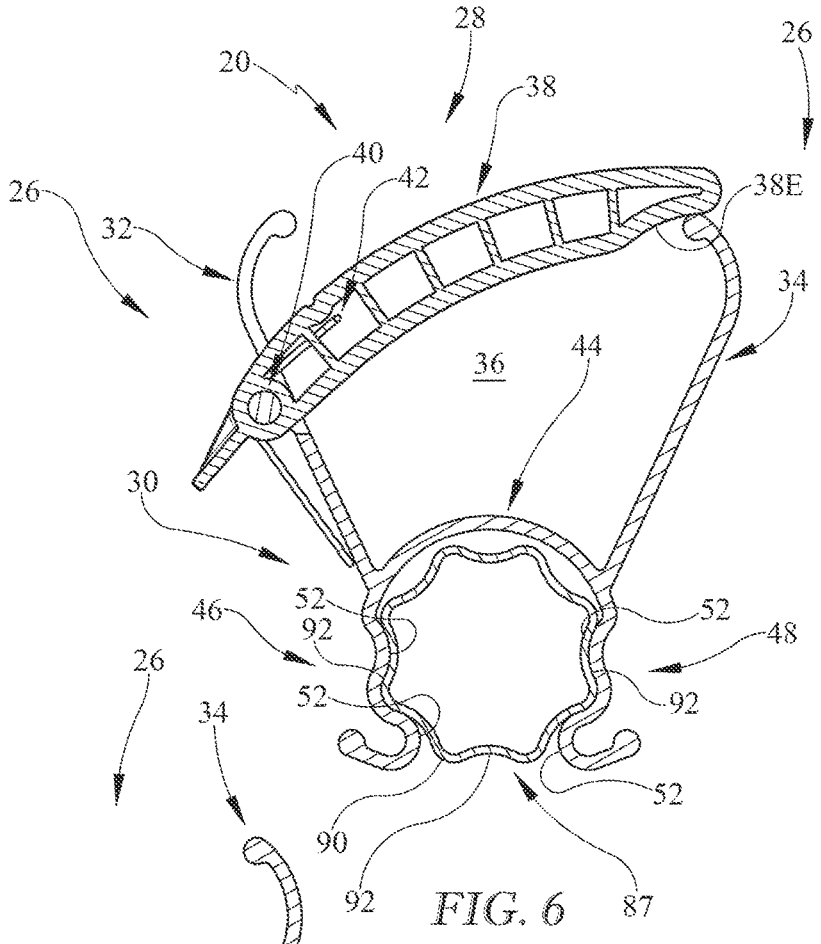
FIG. 6 is a cross-sectional view similar to FIG. 5 showing the retention clip of the retention member has been moved from the partially engaged position as shown in FIG. 5 to a fully engaged position to cause the rear fabric support member to be located in the support-member receiving channel so that frame receiver facets on the clip arms engage with the grooves on the fabric support member to couple the retention clip to the support member, and further showing the retention clamp in the closed position in which the clamp extends between the front and rear fabric retainer arms to block a portion of the quilt-core roll receiving channel.
Figure 7:
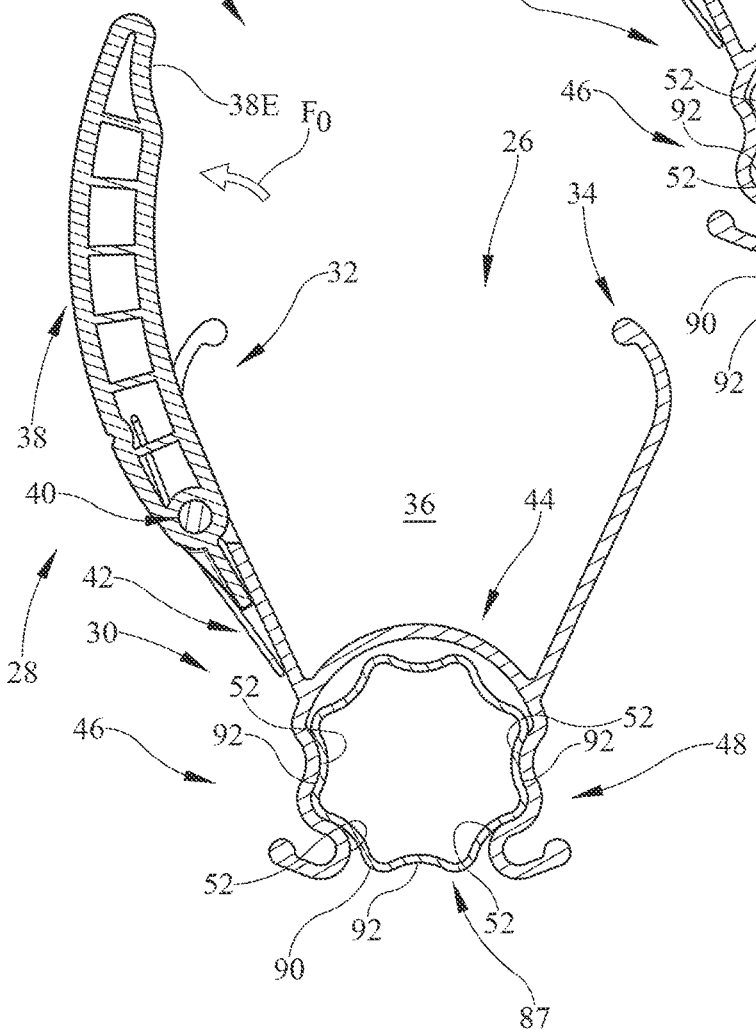
FIG. 7 is a cross-sectional view similar to FIG. 6 showing the retention clamp has pivoted from the closed position to the open position to allow access to the quilt-core roll receiving channel so that the a quilt core roll of the quilt core may be located in the quilt-core roll receiving channel.

Each of the quilt core retention devices 20 includes a quilt core retention member 26 and a spring-biased retention clamp 28 as shown in FIGS. 1B and 3-7. The retention member 26 is formed to include a quilt-core roll receiving channel 36 configured to receive a quilt core roll 100R of unsewn or previously sewn fabric of the quilt core 100. The spring-biased retention clamp 28 pivotably coupled to the quilt core retention member to change between a closed position as shown in FIG. 6 and an open position as shown in FIG. 7. In the closed position, the retention clamp 28 blocks the removal of the quilt core roll 100R out of the quilt-core roll receiving channel 36. In the open position, the retention clamp 28 allows access to the quilt core roll 100R out of the quilt-core roll receiving channel 36.

The quilt core retention member 16 includes a retention clip 30 and a pair of fabric retainer arms 32, 34 as shown in FIGS. 1B and 3-7. The retention clip 30 is configured to selectively couple to the rear fabric support member 87 of the frame assembly 16. The pair of fabric retainer arms 32, 34 each extend from the retention clip 30 away from the rear fabric support member 87. The fabric retainer arms 32, 34 extend at an angle 33 relative to one another in the illustrative embodiment.

The rear fabric retainer arm 34 is spaced apart longitudinally from the front fabric retainer arm 32 to define the quilt-core roll receiving channel 36 as shown in FIGS. 1B and 3-7. The quilt-core roll receiving channel 36 is configured to receive a quilt core roll 100R of unsewn or previously sewn fabric of the quilt core 100 to support the quilt core roll 100R relative to the frame assembly 16 when the quilt core 100 is draped over the frame assembly 16.

In this way, the fabric layers of the sewn/unsewn fabric zones are prevented from interfering with the sewing of the fabric zone 130 positioned on the frame assembly 16 for sewing. Additionally, by securing the quilt core roll 100R to the rear fabric support member 87, successive or subsequent fabric zones 130 may be positioned and secured for sewing without much effort of repositioning the quilt core 100.

Figure 11:
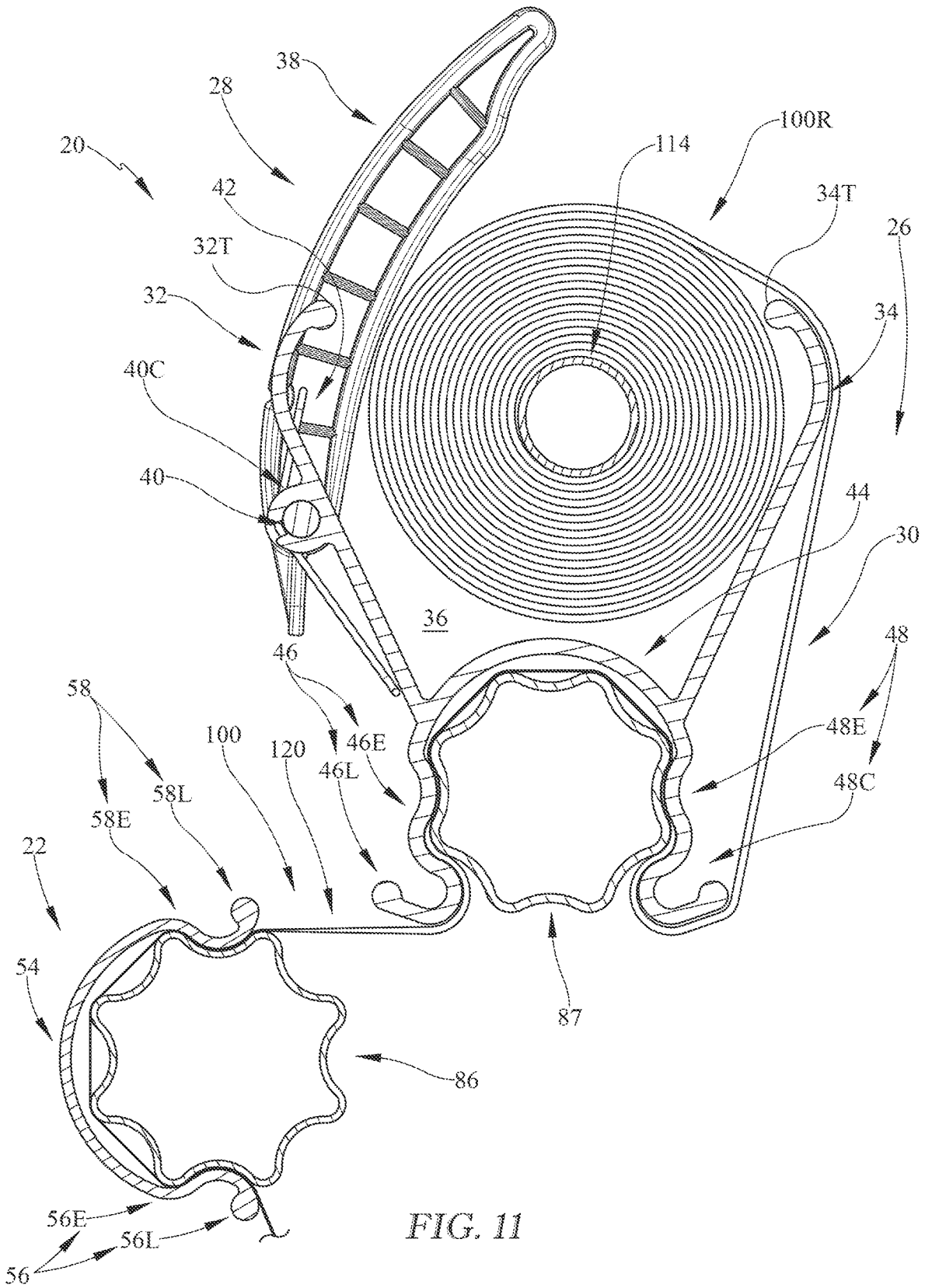
FIG. 11 is a cross-sectional view of the quilt frame unit of FIG. 2 taken along line 11-11 showing the quilt core retention device coupled to the rear fabric support member and one of the retention clips coupled to the front fabric support member with the quilt core draped over the front and rear fabric support members to secure and position a fabric zone of the quilt core on the frame assembly for sewing by the quilting machine, and further showing the quilt core roll located in the quilt-core roll receiving channel of the quilt core retention member with the retention clamp applying a clamp force to the quilt core roll to block the quilt core roll from moving out of the quilt-core roll receiving channel.
Figure 12:
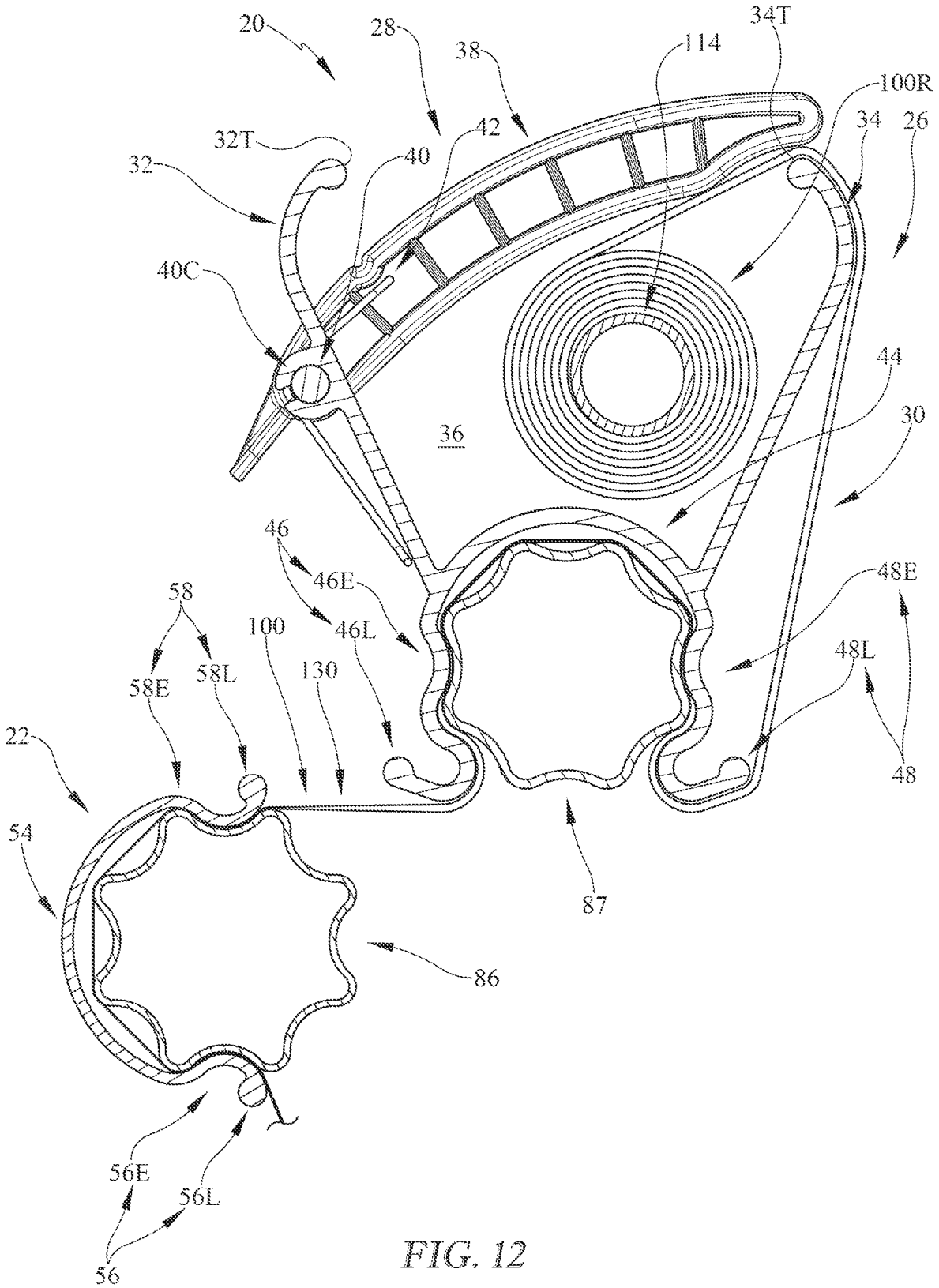
FIG. 12 is a cross-sectional view similar to FIG. 11 showing a portion of the fabric in the quilt core roll has been unrolled from the take up spool and repositioned so that a new fabric zone is secured on the frame assembly for sewing by the quilting machine.

The retention clamp 28 includes a clamp arm 38, a rod 40, and a spring 42 as shown in FIGS. 1B and 3-7. The clamp arm 38 is pivotably coupled to the front fabric retainer arm 32 to change between the closed and open positions. The rod 40 pivotably couples the clamp arm 38 to the front fabric retainer arm 32. The spring 42 extends between the clamp arm 38 and the front fabric retainer arm 32. The spring 42 is configured to provide a clamping force to the clamp arm 38 to urge the clamp arm 38 toward the closed position as shown in FIGS. 11 and 12.

In the closed position, the clamp arm 38 of the retention clamp 28 extends between the pair of fabric retainer arms 32, 34 to engage the quilt core roll 100R located in the quilt-core roll receiving channel 38 to block the quilt core roll 100R from moving out of the quilt-core roll receiving channel 38. In the open position, the clamp arm 38 is spaced apart from the rear fabric retainer arm 34 to allow the quilt core roll 100R to move out of the quilt-core roll receiving channel 36. In the illustrative embodiment, an end 38E of the clamp arm 38 may engage with the rear fabric retainer arm 34 in the closed position.

By biasing the clamp arm 38 toward the closed position, as the quilt core roll 100R is unrolled to position subsequent fabric zones 130 on the frame assembly 16, the user may not need to manually unroll the quilt core roll 100R. To insert the quilt core 100 into the quilt-core roll receiving channel 36, the user needs to apply an open force $F_O$ to the clamp arm 38 to overcome the clamping force. Then, once the quilt core 100 is located in the quilt-core roll receiving channel 36, the user releases the clamp arm 38 allowing the spring 42 to urge the clamp arm 38 back to the closed position.

Turning again to the retention member 26, the retention clip 30 of the retention member 26 includes a clip base 44, a first deflectable clip arm 46, and a second deflectable clip arm 48 as shown in FIGS. 3-7. The first and second deflectable clip arms 46, 48 extend from opposite ends of the clip base 44 to define a support-member receiving channel 50.

The support-member receiving channel 50 is configured to receive the rear fabric support member 87 with the quilt core 100 draped over the rear fabric support member 87. In the illustrative embodiment, the front fabric retainer arm 32, the rear fabric retainer arm 34, and the clip base 44 of the retention clip 30 cooperate to define the quilt-core roll receiving channel 38 as shown in FIGS. 3-7.

Each of the first and second deflectable clip arms 46, 48 includes an engagement portion 46E, 48E and a lip portion 46L, 48L as shown in FIGS. 3-7. The engagement portion 46E, 48E extends from a first end of the clip base 44 and defines a plurality of frame receiver facets 52. Each of the receiver facets 52 are configured to engage with grooves 92 on the rear fabric support member 87 to couple the retention clip 30 to the rear fabric support member 87. The lip portion 46L, 48L extends from the respective engagement portion 46E, 48E away from the rear fabric support member 87 to a terminal end 46T, 48T. In the illustrative embodiments, the lip portion 46L of the first deflectable clip arm 46 and the lip portion 48L of the second deflectable clip arm 48 define a clip throat 30T therebetween.

Figure 3:
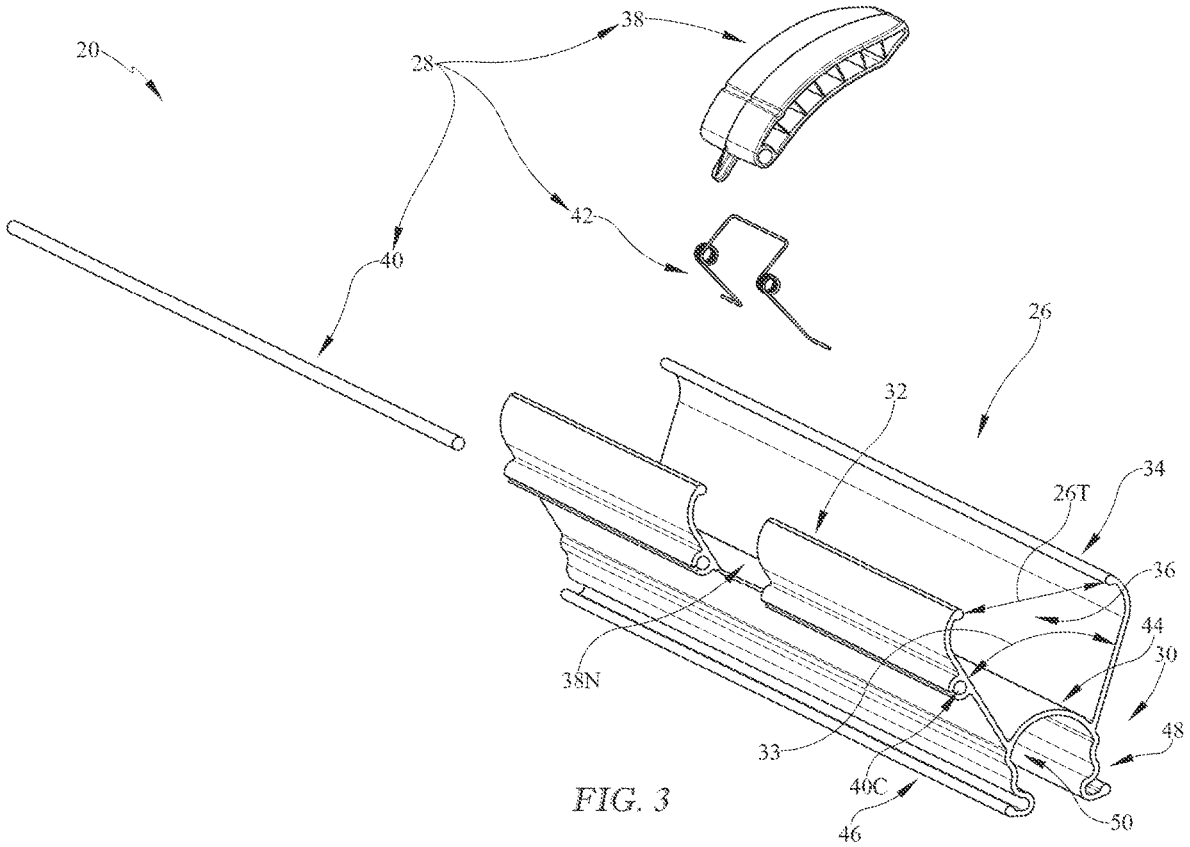
FIG. 3 is an exploded perspective view of one of the quilt core retention devices included in the retention system of the quilting frame unit of FIG. 1 showing the quilt core retention device includes the retention member and the spring-biased retention clamp, the retention member shaped to include a u-shaped retention clip configured to selectively engage the rear fabric support member and front and rear retainer arms that extend from the retention clip away from the rear fabric support member to define the quilt-core roll receiving channel, and the spring-biased retention clamp including a clamp arm, a rod configured to pivotably couple the clamp arm to the front fabric retainer arm, and a spring configured to provide a clamping force to the clamp arm to urge the clamp arm toward the closed position.

In the illustrative embodiment, the retention clip 30 of the retention member 26 has a generally u-shaped or horseshoe shaped cross-section as shown in FIGS. 3-5. The term "u-shaped" when used in reference to the retention clip 30 in this specification, including the claims, shall be defined to include any retention clip shape having a u-shaped, generally u-shaped, or horseshoe shaped cross-section, and to include a retention clip shape having a cross-section in which the retention clip cross-section has a retention clip receiving width 30W which is greater than the retention clip throat width 30T of the retention clip throat 30T as shown in FIGS. 4 and 5.

Each of the first and second deflectable clip arms 46, 48 of the retention clip 30 are elastic such that when the clip arms 46, 48 deflect, they reciprocate back to the original shape. Therefore, the retention clip 30 retains its u-shaped or horseshoe shaped cross-section after attaching or removing the retention clip from the rear fabric support member 87.

The original shape of the retention clip 30 is shown in FIG. 4, where the retention clip 30 is in an unengaged position. As the retention clip 30 is attached to the fabric support member 87, the retention clip 30 moves from the unengaged position to a partially engaged position as shown in FIG. 5, which causes the pair of deflectable clip arms 46, 48 to deflect relative the clip base 44.

In the partially engaged position, the pair of deflectable clip arms 46, 48 are deflected relative the clip base 44 such that the width of the retention clip throat 30T has increased as shown in FIG. 5. This allows the rear fabric support member 87 to move into the support-member receiving channel 50 of the retention clip 30 so that the retention clip 30 is in a fully engaged position as shown in FIG. 6. In the fully engaged position, the rear fabric support member 87 is located in the support-member receiving channel 50 so that frame receiver facets 52 on the clip arms 46, 48 engage with the grooves 92 on the fabric support member 87.

The front and rear fabric retainer arms 32, 34 of the retention member 28 are each shaped to include a base 32B, 34B, and a lip 32L, 34L as shown in FIG. 3-7. The base 32B, 34B extend from the retention clip 30. The lip 32L, 34L extends from the base 32B, 34B to a terminal end 32T, 34T.

The lip 32L of the front fabric retainer arm 32 and the lip 34L of the rear fabric retainer arm 34 define a retention member throat 26T therebetween as shown in FIGS. 3-7. The base 32B of the front fabric retainer arm 32 and the base 34B of the rear fabric retainer arm 34 define a base width 44BW that is less than a width of the retention member throat 36T.

In the illustrative embodiment, the front retainer arm 32 further includes a rod-receiving channel 40C and a clamp-receiving notch 38N as shown in FIG. 3. The rod-receiving channel 40C extends laterally along the front retainer arm 32 and receives the rod 40 of the clamp 28 to couple the rod 40 to the front retainer arm 32. The clamp-receiving notch 38N is formed in the front retainer arm 32 near the middle of the front retainer arm 32 and receives a portion of the clamp arm 38.

Figure 8:
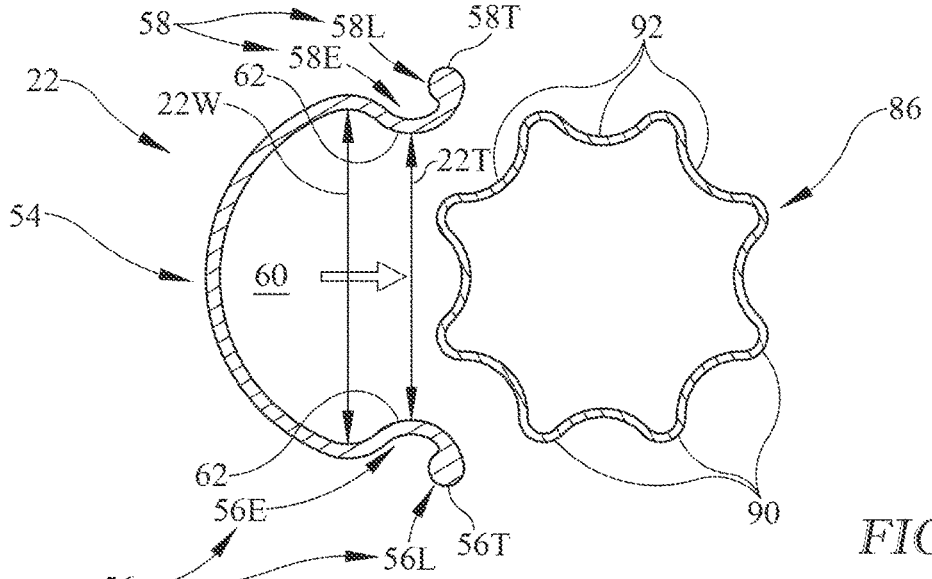
FIG. 8 is a cross-sectional view of one of the quilt core retention clips included in the retention system of the quilt frame unit of FIG. 1 showing the quilt core retention clip includes a clip body have a u-shape cross-section and a pair of deflectable clip arms that each extend from the clip base to define a support-member receiving channel configured to receive one of the front or side fabric support members of the frame assembly when the retention clip is coupled to the respective fabric support member of the frame assembly.
Figure 9:
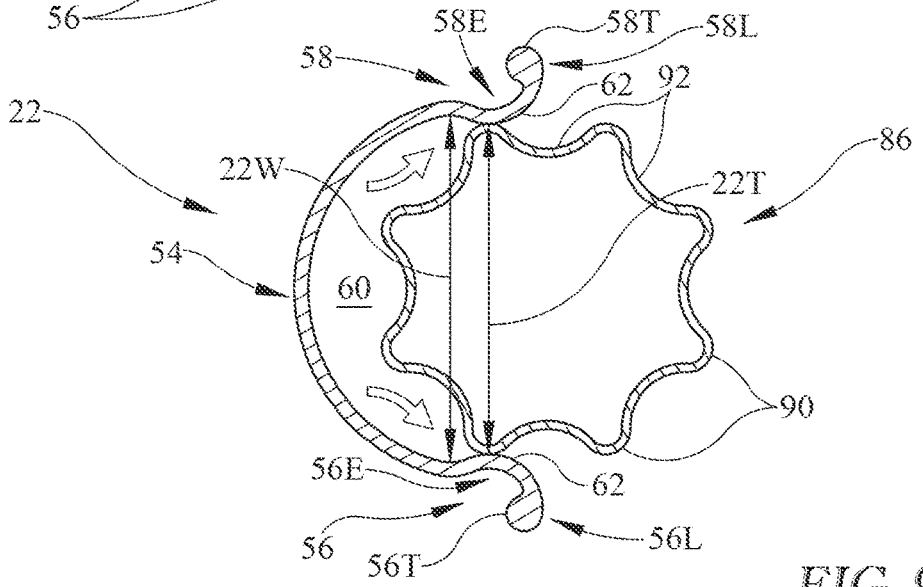
FIG. 9 is a cross-sectional view similar to FIG. 8 showing the retention clip has been moved from an unengaged position as shown in FIG. 8 to a partially engaged position to cause the pair of deflectable clip arms to deflect relative the clip base to allow the support member to move into the support-member receiving channel of the retention clip to couple the retention clip to the support member of the frame assembly.
Figure 10:
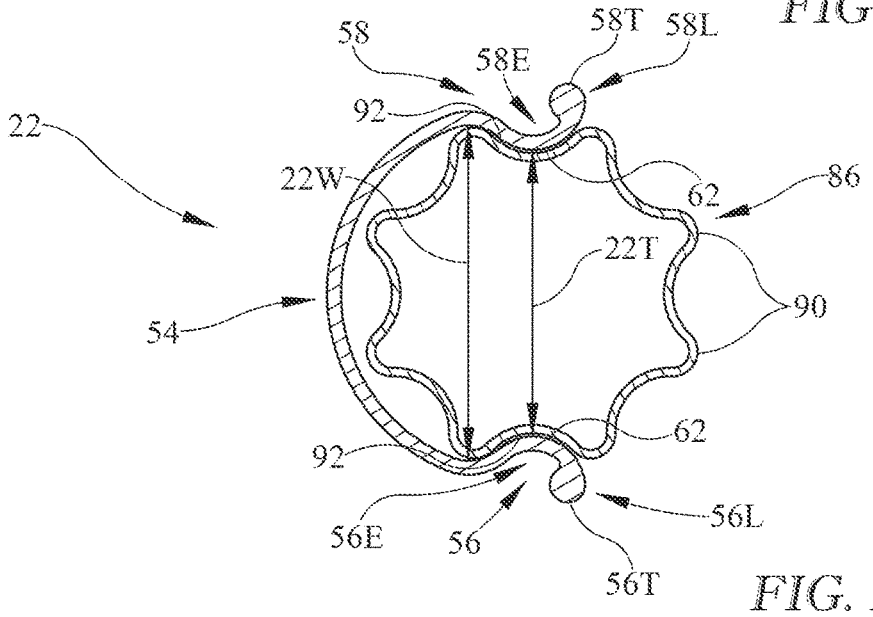
FIG. 10 is a cross-sectional view similar to FIG. 9 showing the retention clip has been moved from the partially engaged position as shown in FIG. 5 to a fully engaged position to cause the support member to be located in the support-member receiving channel so that clip arms are located in grooves on the support member to couple the retention clip to the support member.

The secondary retention clips 22 each include a clip base 54 and a pair of deflectable clip arms 56, 58 as shown in FIGS. 8-10. The pair of deflectable clip arms 56, 58 each extend from opposite ends of the clip base 54 to define a support-member receiving channel 60. The support-member receiving channel 60 is configured to receive one of the fabric support members 86, 88, 89 with the quilt core 100 draped over.

The pair of deflectable clip arms 56, 58 are each configured to engage one of the fabric support members 86, 88, 89 in one of the plurality of grooves 92 to couple the secondary retention clip 22 to the corresponding fabric support member 86, 88, 89. Each deflectable clip arm 56, 58 includes an engagement portion 56E, 58E and a lip portion 56L, 58L as shown in FIGS. 8-10. The engagement portion 56E, 58E extends from a first end of the clip base 54 and defines a plurality of frame receiver facets 62. Each of the receiver facets 62 are configured to engage with grooves 92 on the corresponding fabric support member 86, 88, 89 to couple the retention clip 22 to the corresponding fabric support member 86, 88, 89. The lip portion 56L, 58L extends from the respective engagement portion 56E, 58E to a terminal end 56T, 58T. In the illustrative embodiments, the lip portion 56L of the first deflectable clip arm 56 and the lip portion 58L of the second deflectable clip arm 58 define a clip throat 22T therebetween.

In the illustrative embodiment, the retention clip 22 has a generally C-shaped cross-section as shown in FIGS. 8-10. The term "C-shaped" when used in reference to the retention clip 22 in this specification, including the claims, shall be defined to include any retention clip shape having a C-shaped, or generally C-shaped cross-section, and to include a retention clip shape having a cross-section in which the retention clip cross-section has a retention clip receiving width 22W which is greater than the retention clip throat width 22T of the retention clip throat 22T as shown in FIGS. 8-10. Each of the first and second deflectable clip arms 56, 58 of the retention clip 22 are elastic such that when the clip arms 56, 58 deflect, they reciprocate back to the original shape. Therefore, the retention clip 22, like the retention clip 30 of the quire core retention member 26, retains its C-shaped cross-section after attaching or removing the retention clip 22 from the corresponding fabric support member 86, 88, 89.

The original shape of the retention clip 22 is shown in FIG. 8, where the retention clip 22 is in an unengaged position. As the retention clip 22 is attached to the corresponding fabric support member 86, 88, 89, the retention clip 22 moves from the unengaged position to a partially engaged position as shown in FIG. 9, which causes the pair of deflectable clip arms 56, 58 to deflect relative the clip base 54.

In the partially engaged position, the pair of deflectable clip arms 56, 58 are deflected relative the clip base 54 such that the width of the retention clip throat 22T has increased as shown in FIG. 9. This allows the fabric support member 86, 88, 89 to move into the support-member receiving channel 60 of the retention clip 22 so that the retention clip 22 is in a fully engaged position as shown in FIG. 10. In the fully engaged position, the fabric support member 86, 88, 89 is located in the support-member receiving channel 60 so that frame receiver facets 62 on the clip arms 56, 58 engage with the grooves 92 on the fabric support member 86, 88, 89.

Figure 13:
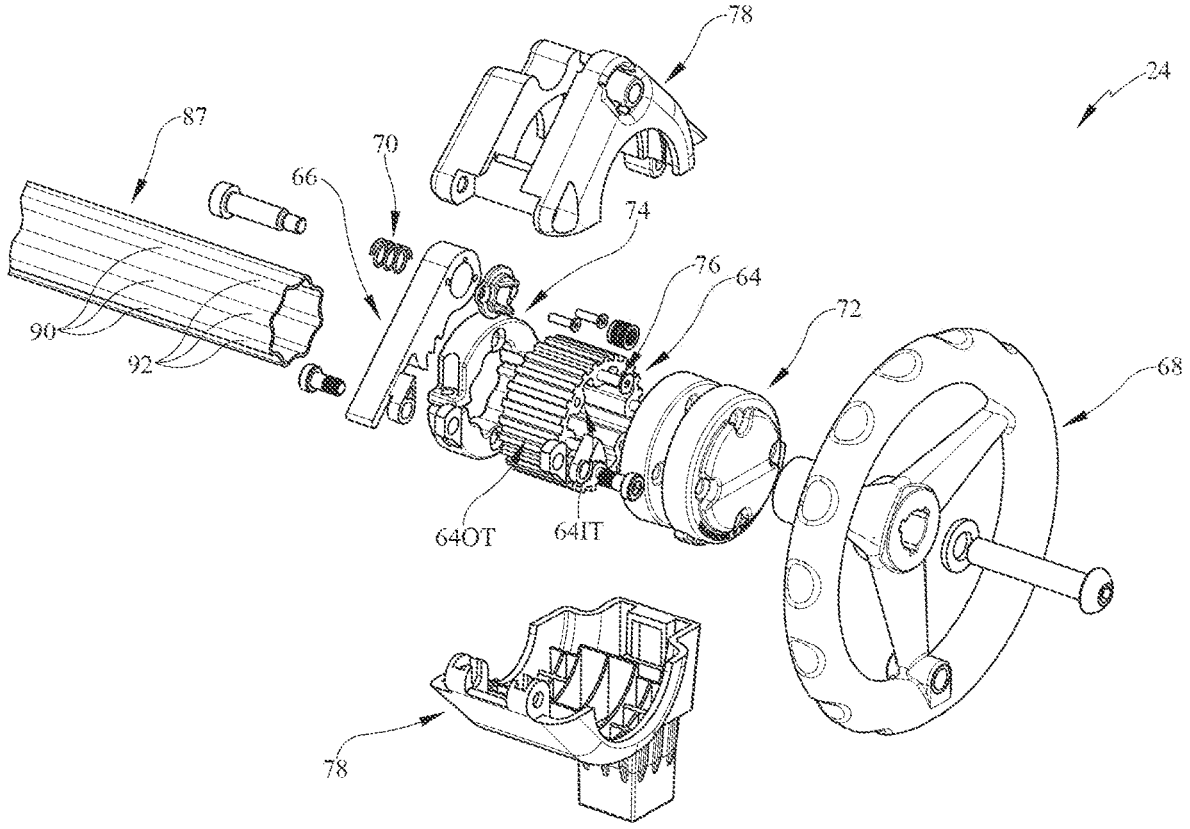
FIG. 13 is an exploded perspective view of the tightening mechanism included in the retention system of the quilt frame unit of FIG. 1 showing the tightening mechanism includes a tightening gear affixed to the rear fabric support member, a pawl pivotably coupled to a housing of the tightening mechanism to selectively change between an engaged position as shown in FIG. 14 and a disengaged position as shown in FIG. 15, and a tightening controller coupled to the tightening gear to control rotation of the tightening gear about the gear axis to adjust the tension in the fabric supported on the frame assembly.
Figure 14:
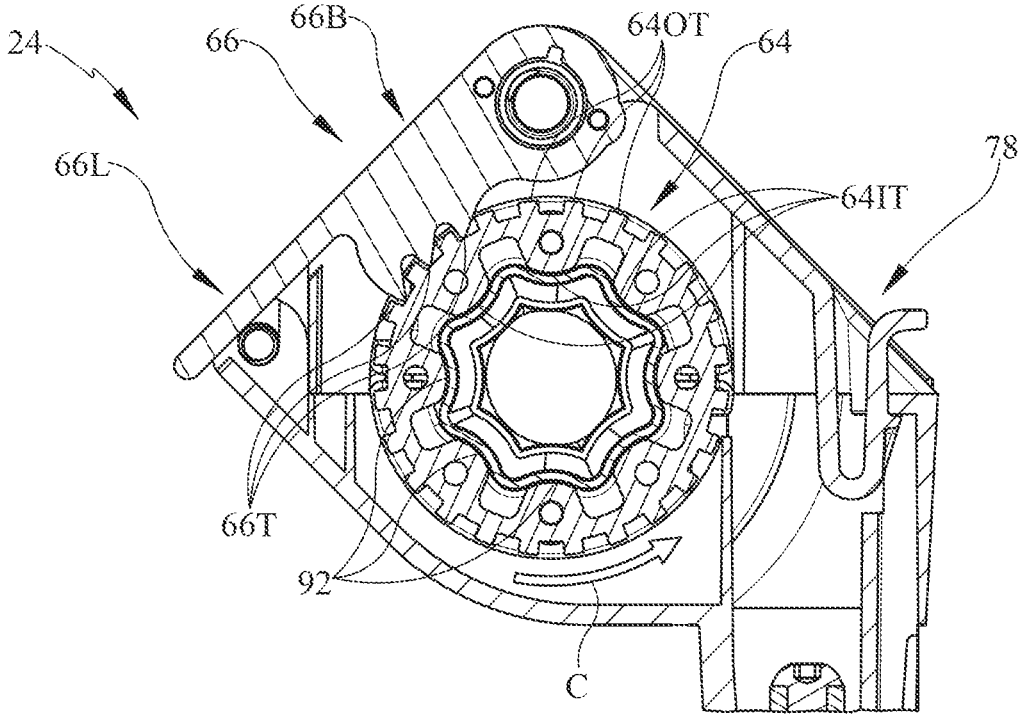
FIG. 14 is a cross-sectional view of the tightening mechanism of FIG. 14 showing the pawl of the tightening mechanism in the engaged position in which teeth formed on the pawl engage with gear teeth formed on the gear to allow rotation of the gear in a tightening direction while blocking rotation of the gear in the opposite direction.
Figure 15:
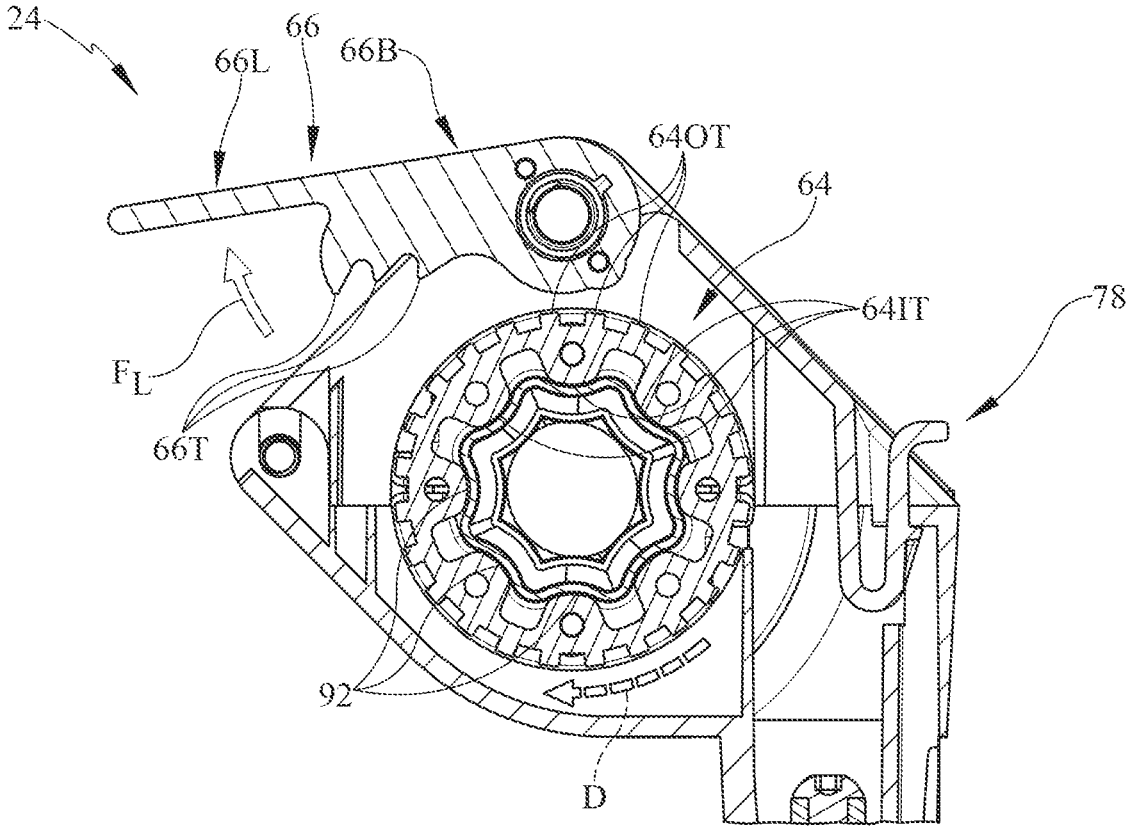
FIG. 15 is cross-sectional view similar to FIG. 14 showing the pawl of the tightening mechanism has been lifted to cause the pawl to pivot to the disengaged position in which the teeth formed on the pawl are spaced apart from the gear teeth formed on the gear to allow rotation of the gear in either the direction about the gear axis.

The tightening mechanism 24 includes a tightening gear 64, a pawl 66, and a tightening controller 68 as shown in FIG. 13. The tightening gear 64 is affixed to the rear fabric support member 87. The pawl 66 is pivotably coupled to a housing 78 of the tightening mechanism 24 to selectively change between an engaged position as shown in FIG. 14 and a disengaged position as shown in FIG. 15. The tightening controller 68 is coupled to the tightening gear 64 to control rotation of the tightening gear 64 about the gear axis 64A to adjust the tension in the fabric supported on the frame assembly 16.

The pawl 66 is shaped to include a pawl body 66B, a plurality of pawl teeth 66T, and a pawl lever 66L as shown in FIGS. 14 and 15. The teeth 66T extends from the pawl body 66B and are configured to mate with outer gear teeth 640T formed on the tightening gear 64. The teeth 66T are shaped so that in the engaged position, the gear 64 is allowed to rotate in a tightening direction C, but is blocked from rotating in the opposite direction D. In the engaged position, the teeth 66T engage with the gear teeth 640T on the gear 64 to block rotation of the gear 64 in the opposite direction D. However, in the disengaged position, the teeth 66T are spaced apart from the gear teeth 640T such that the gear 64 is free to rotate in either direction. The pawl lever 66L extends from the pawl body 66B and is configured to be engaged with a lifting force $F_L$ to cause the pawl 66 to change from the engaged position to the disengaged position as shown in FIG. 15.

In the illustrative embodiment, the pawl 66 is spring biased by a spring 70 as shown in FIG. 13. The spring 70 biases the pawl 66 toward the engaged position. To change the pawl 66 to the disengaged position, the user applies the lifting force $F_L$ to the pawl 66 to overcome the bias force of the spring 70.

Figure 16:
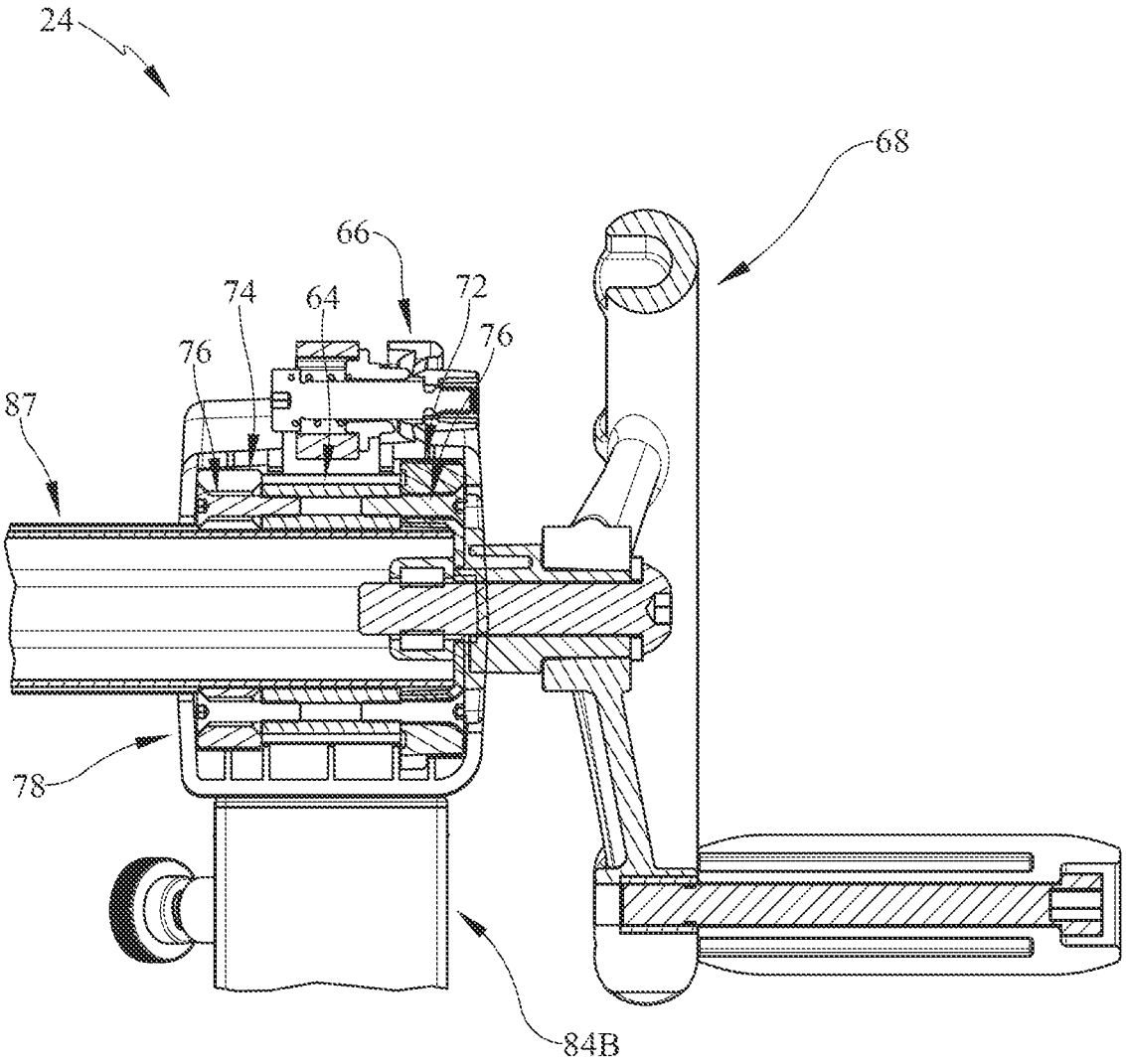
FIG. 16 is a cross-sectional view of the tightening mechanism of FIG. 14 showing tightening mechanism further includes a mount assembly configured to mount the tightening mechanism to the rear fabric support member, and further showing the mount assembly includes a controller mount bracket arranged on one side of the gear, a support-member mount bracket arranged on the other side to locate the gear axially between the mount brackets, fasteners that extend through the controller mount bracket, the gear, and the support-member mount bracket to fix the tightening controller to the gear and the rear fabric support member.

In the illustrative embodiment, the tightening controller 68 is a wheel as shown in FIG. 13. The wheel 68 is coupled to the gear 64 by a mount assembly including a controller mount bracket 72, a support-member mount bracket 74, fasteners 76, and the mount housing 78 as shown in FIGS. 13 and 16. The controller mount bracket 72 is arranged on one side of the gear 64, while the support-member mount bracket 74 is arranged on the other side to locate the gear 64 axially between the controller mount bracket 72 and the support-member mount bracket 74. The fasteners 76 extend through the controller mount bracket 72, the gear 64, and the support-member mount bracket 74 to fix the wheel 68 to the gear 64 and the rear fabric support member 87. The housing 78 encases the components and coupled to the frame assembly 16.

The gear 64 is also shaped to include a plurality of inner gear teeth 64IT as shown in FIGS. 13-15. The inner gear teeth 64IT extend radially inward from the inner diameter of the gear 64. The inner gear teeth 64IT engage with grooves 92 formed on the rear fabric support member 87 to couple the gear 64 with the rear fabric support member 87.

Turning again to the frame support structure 12, the frame support structure 12 includes a first end support 80, a second end support 82, and frame support members 84A, 84B, 84C, 84D as shown in FIGS. 1 and 2. Front carriage track 95 and rear carriage track 96 included in the machine carriage assembly 14 each extend laterally between and interconnect the first and second end supports 80, 82. The frame support members 84A, 84B connects the frame assembly 16 to the first end support 80, while the frame support members 84C, 84D connects the frame assembly 16 to the second end support 82.

The frame assembly 16 includes the plurality of fabric support members 86, 87, 88, 89 as shown in FIGS. 1 and 2. The plurality of fabric support members 86, 87, 88, 89 are configured to support the quilt core 100 relative to the quilting machine 110.

The plurality of fabric support members 86, 87, 88, 89 includes a front fabric support member 86, a rear fabric support member 87, a first end fabric support member 88, and a second end fabric support member 89 as shown in FIGS. 1 and 2. The first end fabric support member 88 is coupled to the first end support 54 of the frame support structure 12. The second end fabric support member 89 is spaced apart laterally from the first end fabric support member 88. The second end fabric support member 89 is coupled to the second end support 56 of the frame support structure 12.

The front fabric support member 86 extends laterally between and interconnects the first end fabric support member 88 and the second end fabric support member 89. The rear fabric support member 87 is spaced apart longitudinally from the front fabric support member 86. The rear fabric support member 87 extends laterally between the first end support 54 and the second end support 56 of the frame support structure 12 through the machine throat 112 of the quilting machine 110.

Each of the plurality of fabric support members 86, 87, 88, 89 is shaped to include ridges 90 and grooves 92 as shown in FIGS. 4-5 and 8-10. The frame receiver facets 52, 62 engage with the grooves 92 on the one fabric support member 86, 87, 88, 89 to couple the corresponding retention clip 30, 22 to the fabric support member 86, 87, 88, 89.

The machine carriage assembly 14 includes a machine carriage 94, a front carriage track 95, and a rear carriage track 96 as shown in FIGS. 1 and 2. The machine carriage 94 is supported on the front and rear carriage tracks 95, 96, which are affixed to the first and second end supports 80, 82.

The machine carriage 94 includes front carriage rollers (not shown) and rear carriage rollers (not shown) that provide for carriage lateral movement A, and thus for the machine lateral movement of the quilting machine 110 as shown in FIG. 2. The machine carriage 94 also includes a pair of longitudinal tracks 97, 98 that support the quilting machine 110 with an integral wheeled base (not shown) or a separate wheeled machine base to which a quilting machine 110 may be removably mounted. The longitudinal tracks 97, 98 provide for machine longitudinal movement B of the quilting machine 110 as shown in FIG. 2.

To begin sewing the quilt core 100, the quilt core 100 may be draped over the fabric support members 86, 87, 88, 89 of the frame assembly 16 and secured to the fabric support members 86, 87, 88, 89 using the retention system 18. The quilt core 100 is secured in place by coupling the retention clip 30 of the quilt core retention member 28 to the rear fabric support member 87 so that the rear fabric support member 87 is received in the support-member receiving channel 50 with the quilt core 100 draped over.

The quilt core roll 100R may be located in the quilt-core roll receiving channel 36 to move the unsewn or previously sewn fabric of the quilt core out of the way. This helps keep the fabric layers of the sewn fabric zones from interfering with the sewing of the fabric zone 120 to be positioned on the frame assembly 16 for sewing.

To locate the quilt core roll 100R in the quilt-core roll receiving channel 36, the user applies the opening force $F_O$ to the clamp arm 38 to move the clamp arm 38 to the open position. Once the quilt core roll 100R is located in the quilt-core roll receiving channel 36, the user releases the clamp arm 38 and the spring 42 urges the clamp arm 38 back to the closed position.

Next, the quilt core 100 is secured to the other fabric support members 86, 88, 89 with the secondary retention clips 22. Multiple secondary retention clips 22 may be used for each fabric support member 86, 88, 89 as shown in FIG. 2. The secondary retention clips 22 are coupled to the respective fabric support member 86, 88, 89 so that the respective fabric support member 86, 88, 89 is received in the support-member receiving channel 60 with the quilt core 100 draped over.

This may position a fabric zone 120 of the quilt core 100 for sewing by the quilting machine 110 as shown in FIG. 11. As shown in FIG. 11, the quilt core 100 extends out of the quilt-core roll receiving channel 36 over the rear fabric retainer arm 34, around the lip portion 48L of the retention clip 30, and wraps around the rear fabric support member 87 so that the quilt core 100 is between the rear fabric support member 87 and the clip base 44 of the retention clip 30. The quilt core 100 engages the other lip portion 46L and extends over to the front fabric support member 86, where the quilt core 100 wraps around the front fabric support member 86 so that the quilt core 100 is between the front fabric support member 86 and the clip base 54 of the retention clip 22.

Before sewing, the tightening mechanism 24 may be used to provide tension to the fabric zone 120 by rotating the tightening controller 68 in the tightening direction C. When the quilt core 100 is secured and the desired fabric zone 120 is in place, the quilting machine 110 may be operated by the user to sew the desired quilting pattern into the fabric zone 120.

Once the sewing of the fabric zone 120 is completed, the secondary retention clips 22 may be removed from each of the fabric support members 86, 88, 89. The quilt core 100 may then be moved and repositioned on the fabric support members 86, 88, 89 in a new position. By moving the quilt core 100, the quilt core roll 100R may be partially unrolled from the take-up spool 114, like as shown in FIG. 12. Alternatively, the sewn fabric may be spooled onto the take-up spool 114 by moving the quilt core 100 relative to the frame assembly 16.

The quilt core 100 may then be re-secured by coupling the secondary retention clips 22 to each of the respective fabric support members 86, 88, 89. This may position a new fabric zone 130 of the quilt core 100 for sewing by the quilting machine 110 as shown in FIG. 12.

The retention system 18 allows for flexibility in the sequence of sewing the respective fabric zones 120, 130. The retention system 18 allows the user to reposition the quilt core 100 as desired, while keeping the sewn or unsewn fabric out of the way. The quilt core retention devices 20 also allow the quilt core to easily be changed between machines if needed. As the quilt core roll 100R is located in the quilt-core roll receiving channel 36, if the quilt core 100 were to be changed to a different frame support structure 12 and frame assembly 16, the user only need remove the retention clips 30 from the rear fabric support member 87. The quilt core 100 may remain in the quilt-core roll receiving channel 36 on the fabric take-up spool 114, while the retention clips 30 are removed from the rear fabric support member 87. The retention clip 28 would keep the quilt core roll 100R in the channel 26 during the exchange.

To remove the quilt core retention devices 20 from the rear fabric support member 87, the user may squeeze the fabric retainer arms 32, 34 together. This may cause the deflectable clip arms 46, 48 to deflect away from the rear fabric support member 87, which spaces the receiver facets 52 away from the grooves 92 on the rear fabric support member 87 and allow the quilt core retention devices 20 to be removed from the rear fabric support member 87. This may aid in the removal of the quilt core retention devices 20 from the rear fabric support member 87, making it easier.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A quilting frame unit for supporting a quilt core to be sewn by a quilting machine, comprising:

a frame support structure adapted to support a machine carriage assembly, the machine carriage assembly providing for lateral and longitudinal movement of the quilting machine;

a frame assembly affixed to the frame support structure, the frame assembly including a plurality of fabric support members configured to support the quilt core relative to the quilting machine;

a retention system comprising one or more quilt core retention members that each include:

a retention clip configured to selectively couple to one support member of the plurality of fabric support members with the quilt core draped over the plurality of fabric support members to retain the quilt core to the one support member, the retention clip shaped to define a support-member receiving channel configured to receive the one support member of the quilting frame;

a pair of fabric retainer arms that each extend from the retention clip away from the one support member, the pair of fabric retainer arms spaced apart longitudinally from one another to define a quilt-core roll receiving channel configured to receive a quilt core roll of unsewn or previously sewn fabric of the quilt core to support the quilt core roll relative to the quilting frame when the quilt core is draped over the quilting frame; and a spring-biased retention clamp pivotably coupled to one fabric retainer arm included in the pair of fabric retainer arms to change between a closed position in which the retention clamp extends between the pair of fabric retainer arms to engage the quilt core roll located in the quilt-core roll receiving channel to block the quilt core roll from moving out of the quilt-core roll receiving channel and an open position in which the retention clamp is spaced apart from the other retainer arm to allow the quilt core roll to move out of the quilt-core roll receiving channel wherein the retention clip and the pair of fabric retainer arms are integrally formed as a single piece component.

2. The quilting frame unit of claim 1, wherein the spring-biased retention clamp comprises:

a clamp arm, a rod that pivotably couples the clamp arm to the one fabric retainer arm included in the pair of fabric retainer arms, and a spring that extends between the clamp arm and the one fabric retainer arm included in the pair of fabric retainer arms and configured to provide a clamping force to the clamp arm to urge the clamp arm toward the closed position.

3. The quilting frame unit of claim 1, wherein the retention clip comprises:

a clip base, a first deflectable clip arm that extends from a first end of the clip base, and a second deflectable clip arm that extends from a second end spaced apart from the first end of the clip base to define the support-member receiving channel, and wherein the pair of fabric retainer arms and the clip base cooperate to define the quilt-core roll receiving channel.

4. The quilting frame unit of claim 3, wherein each of the first and second deflectable clip arms comprises:

an engagement portion that defines a plurality of frame receiver facets each configured to engage with grooves on the one support member to couple the retention clip to the one support member, and a lip portion that extends from the engagement portion away from the one support member to a terminal end, wherein the lip portion of the first deflectable clip arm and the lip portion of the second deflectable clip arm define a clip throat therebetween.

5. The quilting frame unit of claim 1, wherein the front and rear pair of fabric retainer arms extend at an angle relative to one another.

6. The quilting frame unit of claim 5, wherein the pair of fabric retainer arms includes a front fabric retainer arm and a rear fabric retainer arm spaced apart longitudinally from the front fabric retainer arm, and wherein the front and rear fabric retainer arms of the retention member are each shaped to include:

a base that extends from the retention clip, and a lip that extends from the base to a terminal end, wherein the lip of the front fabric retainer arm and the lip of the rear fabric retainer arm define a retention member throat therebetween and the base of the front fabric retainer arm and the base of the rear fabric retainer arm define a base width that is less than a width of the retention member throat.

7. The quilting frame unit of claim 1, wherein the retention clip comprises:

a clip base, and a pair of deflectable clip arms that extend from opposite ends of the clip base, wherein the clip base and the pair of deflectable clip arms cooperate to define the support-member receiving channel, and wherein the pair of fabric retainer arms and the clip base cooperate to define the quilt-core roll receiving channel.

8. The quilting frame unit of claim 7, wherein each deflectable clip arm included in the pair of deflectable clip arms comprises:

an engagement portion that defines a plurality of frame receiver facets each configured to engage with grooves on the one support member to couple the retention clip to the one support member, and a lip portion that extends from the engagement portion away from the one support member to a terminal end, wherein the lip portion of a first deflectable clip arm and the lip portion of a second deflectable clip arm define a clip throat therebetween.

9. The quilting frame unit of claim 1, wherein the frame assembly comprises:

a first end fabric support member coupled to a first end support of the frame support structure, a second end fabric support member spaced apart laterally from the first end fabric support member and coupled to a second end support of the frame support structure, a front fabric support member that extends laterally between and interconnects the first end fabric support member and the second end fabric support member, and a rear fabric support member spaced apart longitudinally from the front fabric support member that extends laterally between the first end support and the second end support of the frame support structure through a throat of the quilting machine, wherein the one or more quilt core retention members are configured to selectively couple to the rear fabric support member with the quilt core draped over the rear fabric support member.

10. The quilting frame of claim 9, wherein the retention system further comprises one or more secondary retention clips configured to couple to one of the first end fabric support member, the second end fabric support member, and the front fabric support member with the quilt core draped over to retain the quilt core to the first end fabric support member, the second end fabric support member, or the front fabric support member.

11. The quilting frame unit of claim 10, wherein the first end fabric support member, the second end fabric support member, the front fabric support member, and the rear fabric support member each have a substantially octagonal cross-section with a plurality of grooves, and wherein the one or more secondary retention clips are configured to engage one of the first end fabric support member, the second end fabric support member, and the front fabric support member in one of the plurality of grooves to couple the secondary retention clip to the first end fabric support member, the second end fabric support member, or the front fabric support member.

12. The quilting frame unit of claim 11, wherein the one or more secondary retention clips comprises a clip base, and a pair of deflectable clip arms that extend from opposite ends of the clip base to define the support-member receiving channel configured to receive one of the first end support member, the second end support member, and the front fabric support member with the quilt core draped over the first end support member, the second end support member, or the front fabric support member, wherein the pair of deflectable clip arms are each configured to engage one of the first end fabric support member, the second end fabric support member, and the front fabric support member in one of the plurality of grooves to couple the secondary retention clip to the first end fabric support member, the second end fabric support member, or the front fabric support member.

13. A quilt core retention device adapted to retain a quilt core to be sewn by a quilting machine to a quilting frame, the retention device comprising a retention clip configured to selectively couple a laterally-extending support member of the quilting frame with the quilt core draped over the support member to retain the quilt core to the support member, the retention clip shaped to define a support-member receiving channel configured to receive the support member of the quilting frame;

a pair of fabric retainer arms that each extend from the retention clip away from the support member of the quilting frame, the pair of fabric retainer arms spaced apart longitudinally from one another to define a quilt-core roll receiving channel configured to receive a quilt core roll of unsewn or previously sewn fabric of the quilt core to support the quilt core roll relative to the quilting frame when the quilt core is draped over the quilting frame; and a spring-biased retention clamp pivotably coupled to one retainer arm included in the pair of fabric retainer arms to change between a closed position in which the retention clamp extends between the pair of fabric retainer arms to engage the quilt core roll located in the quilt-core roll receiving channel to block the quilt core roll from moving out of the quilt-core roll receiving channel and an open position in which the retention clamp is spaced apart from the other retainer arm to allow the quilt core roll to move out of the quilt-core roll receiving channel;

wherein the retention clip and the pair of fabric retainer arms are integrally formed as a single piece component.

14. The retention device of claim 13, wherein the retention clip of the quilt core retention member includes a clip base, a first deflectable clip arm that extends from a first end of the clip base, and a second deflectable clip arm that extends from a second end spaced apart from the first end of the clip base to define the support-member receiving channel; and wherein the pair of fabric retainer arms and the clip base cooperate to define the quilt-core roll receiving channel.

15. The retention device of claim 14, wherein each of the first and second deflectable clip arms include an engagement portion that defines a plurality of frame receiver facets each configured to engage with grooves on the support member to couple the retention clip to the support member and a lip portion that extends from the engagement portion away from the support member to a terminal end, wherein the lip portion of the first deflectable clip arm and the lip portion of the second deflectable clip arm define a clip throat therebetween.

16. The retention device of claim 13, wherein the pair of fabric retainer arms extend at an angle relative to one another.

17. The retention device of claim 13, wherein the retention clip includes a clip base and a pair of deflectable clip arms that each extend from the clip base, the clip base and the pair of deflectable clip arms cooperate to define the support-member receiving channel configured to receive the support member with the quilt core draped over the support member, and wherein the pair of fabric retainer arms and the clip base cooperate to define the quilt-core roll receiving channel.

18. A method for retaining a quilt core to a quilt frame unit for sewing by a quilting machine, the method comprising providing quilting frame unit comprising a frame support structure adapted to support a machine carriage assembly, a frame assembly affixed to the frame support structure, the frame assembly including a plurality of fabric support members, and a retention system including one or more quilt core retention members that each have a retention clip, a pair of fabric retainer arms that each extend from the retention clip away from the support member of the quilting frame, and a spring-biased retention clamp pivotably coupled to one retainer arm included in the pair of fabric retainer arms, the pair of fabric retainer arms spaced apart longitudinally from one another to define a quilt-core roll receiving channel, the retention clip shaped to define a support-member receiving channel configured to receive one of the plurality of support members of the quilting frame;

draping the quilt core over the plurality of fabric support members of the frame assembly;

coupling the retention clip of the quilt core retention member to a rear fabric support member included in the plurality of fabric support members of the frame assembly with the quilt core draped over the rear fabric support member to retain the quilt core to the rear fabric support member;

pivoting the retention clamp to an open position in which the retention clamp is spaced apart from the other retainer arm to allow the quilt core roll to move into the quilt-core roll receiving channel;

locating a quilt core roll of unsewn or previously sewn fabric of the quilt core in the quilt core roll receiving channel to support the quilt core roll relative to the frame assembly when the quilt core is draped over the frame assembly, and pivoting the retention clamp to a closed position in which the retention clamp extends between the pair of fabric retainer arms to engage the quilt core roll located in the quilt-core roll receiving channel to block the quilt core roll from moving out of the quilt-core roll receiving channel after the quilt core role is located in the quilt core roll receiving channel, wherein the retention clip and the pair of fabric retainer arms are integrally formed as a single piece component.

* * * * *